US011667029B1

(12) United States Patent
Hsieh

(10) Patent No.: US 11,667,029 B1
(45) Date of Patent: Jun. 6, 2023

(54) THREE-AXIS END-LIMITING TOOL PLACEMENT STRUCTURE

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 11 days.

(21) Appl. No.: 17/583,991

(22) Filed: Jan. 25, 2022

(51) Int. Cl.
*B25H 3/06* (2006.01)
*B25H 3/02* (2006.01)

(52) U.S. Cl.
CPC ..... *B25H 3/06* (2013.01); *B25H 3/02* (2013.01)

(58) Field of Classification Search
CPC . B25H 3/04; B25H 3/003; B25H 3/06; B25H 1/12; B25H 3/00; B25H 3/006; B25B 13/56; B25B 13/06; B65D 73/0014; B65D 1/36; B65D 85/20
USPC ..... 483/58, 3; 211/70.6, 162, 94.01, 94.02; 206/378, 377, 350, 557, 558, 559, 560, 206/561, 564, 565, 372
See application file for complete search history.

(56) References Cited

U.S. PATENT DOCUMENTS 8,069,995 B2 * 12/2011 Winnard ..... B25H 3/003 211/89.01
8,152,003 B1 * 4/2012 Kao ..... B25H 3/04 211/94.01
9,126,329 B2 * 9/2015 Kao ..... F16M 13/022
9,364,949 B2 6/2016 Ernst
10,919,142 B2 * 2/2021 Hsieh ..... B25H 3/04
11,453,113 B1 * 9/2022 Hsieh ..... B25H 3/06
2001/0001197 A1 * 5/2001 Ramsey ..... B25H 3/06 206/378
2003/0234196 A1 * 12/2003 Hu ..... B25H 3/04 206/372
2009/0211932 A1 * 8/2009 Schmitt ..... B25H 3/003 206/373
2014/0190853 A1 * 7/2014 Ernst ..... B25H 3/06 206/378
2015/0122750 A1 * 5/2015 Kao ..... B25H 3/003 211/13.1
2016/0031074 A1 * 2/2016 Su ..... B25H 3/04 206/349
2016/0271788 A1 * 9/2016 Hsieh ..... B25H 3/04
2020/0406447 A1 * 12/2020 Hsieh ..... B25H 3/04

* cited by examiner

*Primary Examiner* — Steven A. Reynolds
*Assistant Examiner* — Prince Pal
(74) *Attorney, Agent, or Firm* — Egbert, McDaniel & Swartz, PLLC

(57) ABSTRACT

A three-axis end-limiting tool placement structure includes a basic face, a first-end three-axis limiting portion, a second-end X-axis limiting portion, and a sliding Z-axis limiting piece at the second end. The first end of the three-axis limiting part includes one end abutting wall, two lateral limiting walls and a pressing edge, so that the first end of the tool placement bar reaches the X, Y, Z axial limiting state. The X-axis limiting portion is used to limit at least the X-axis of the second end of the tool placement bar. The sliding Z-axis limiting piece at the second end includes a track set and a sliding cover, and the sliding cover has a release and locking positions. When the sliding cover is in locked position, the cover is blocked on the top surface of the second end of the tool placement bar, thereby forming the Z-axis in limiting state.

8 Claims, 8 Drawing Sheets

THREE-AXIS END-LIMITING TOOL PLACEMENT STRUCTURE

CROSS-REFERENCE TO RELATED U.S. APPLICATIONS

Not applicable.

BACKGROUND OF THE INVENTION

1. Field of the Invention

The present invention relates generally to a tool placement structure, and more particularly to an innovative design of a three-axis end-limiting tool placement structure.

2. Description of Related Art Including Information Disclosed Under 37 CFR 1.97 And 37 CFR 1.98

The tool placement structure referred to in the present invention is usually used for placement of a set of tools of multiple sizes, such as a set of sleeves, a set of screwdriver bits etc. Such a tool placement structure is usually divided into multiple units for placement of tools of different specifications or shapes. The tools in different units are arranged and positioned on different frame plates, and such frame plates are assembled together on a base structure. With such a design, when the user needs to use the tools in one of the units only, he can just take the corresponding frame plate and does not need to carry or move the whole base structure. This provides much convenience.

However, in the above-mentioned prior-art structure, an appropriate positioning structure is missing between the frame plate and the base structure. This results in a problem that the frame plates can become loose or displaced, or even fall off the base structure. In view of this problem, some manufacturers have developed another type of prior-art tool placement structure. An example is disclosed in US Patent U.S. Pat. No. 9,364,949B2 titled "Sliding Rail and Tray for Socket Spanners" (note: the component numbers shown below are based on U.S. Pat. No. 9,364,949B2 descriptions). In this prior art, whether or not the sliding rail 14 can be detached from the tray 12 is a structural design at its button 56 part. When the button 56 is pressed down by the user, the locking edge 52 of its flexible arm will be lowered to a position below the bottom face of the sliding rail 14, so that the sliding rail 14 can slide on the top of the flexible arm in a released state. Through a slit 70 formed between the wall of the button 56 and the bottom of the tray 12, the button 56 can be pressed down and swing freely.

However, the prior-art structural design described in the previous paragraph still has some problems in actual use. For example, considering safety issues, such tool placement structures usually must undergo a drop test before they leave the factory, so as to test the stability of assembly between the sliding rail 14 and the tray 12. During the test, as the button 56 can swing freely, when the whole tool placement structure product is dropped from a height and reaches the ground, the button 56 may be easily affected by the sudden shock and be displaced, resulting in automatic release, sliding and falloff of the sliding rail 14. In other words, the prior-art tool placement structure still has the problem that the assembly between the sliding rail 14 and the tray 12 is unstable. Because they may fall apart during usage, there is a concern for safety.

BRIEF SUMMARY OF THE INVENTION

The main object of the present invention is to provide a three-axis end-limiting tool placement structure. It aims to solve the above-mentioned problem and make an innovative breakthrough by developing an ideal and practical new-style tool placement structure. The three-axis end-limiting tool placement structure is used for assembly and positioning of tool placement bars in a detachable form. Each tool placement bar is a long bar-shape structure formed with a first end, a second end and a long plate section. The first end and second end respectively includes an end portion, a top face and side edges. The long plate section is slidably disposed with a plurality of tool placement seats. Each tool placement seat is protruded with a tool placement portion, and a Z axis is defined based on the direction toward which the tool placement portion protrudes.

Based on the above object, the main problem-solving technical feature of the present invention is that the three-axis end-limiting tool placement structure includes:

- a basic face portion, with an X axis and a Y axis defined based on the directions toward which the basic face portions extend away from each other, and at least one placement zone is defined by the basic face portion;
- a first end three-axis limiting portion, formed in each of the placement zones of the basic face portion at a position corresponding to the first end of the tool placement bar, the first end three-axis limiting portion includes an end-side abutting wall, two lateral limiting walls, and at least one pressing edge, wherein the end-side abutting wall is used to abut the corresponding end portion of the first end of the tool placement bar, so that the X axis is rigidly abutted and limited, the two lateral limiting walls are used to abut the corresponding side edges of the first end of the tool placement bar, so that the Y axis is rigidly abutted and limited, the at least one pressing edge is used to press the corresponding top face of the first end of the tool placement bar, so that the Z axis is rigidly abutted and limited; each pressing edge is further formed with an inclined guiding face, the inclined guiding face has an inclined upper inlet end;
- a second end X axis limiting portion, formed in each of the placement zones of the basic face portion and at a position corresponding to the second end of the tool placement bar, the shape of the second end X axis limiting portion is to limit at least the X axis of the corresponding second end of the tool placement bar; and
- a second end sliding Z axis stopper, formed at a position adjacent to the second end X axis limiting portion, the second end sliding Z axis stopper includes a rail set and a slide cover, wherein the slide cover is slidably disposed on the rail set and can be pushed to move back and forth along the X axis, so that the slide cover can have a released position and a locked position in usage;
- specifically, when the slide cover is at the locked position, it is used to cover and stop the top face of the second end of the tool placement bar, so as to limit the Z axis, and when the slide cover is at the released position, the second end of the tool placement bar is released to be movable in the direction of the Z axis;
- further, an inclined upward extending line is defined based on the inclined upper inlet end of the inclined guiding face, and the extending path of the inclined upward extending line L1 is configured above the top end of the slide cover of the second end sliding Z axis stopper.

The main efficacy or advantage of the present invention is that the tool placement bars can be firmly assembled in the placement zone of the basic face portion, and kept stable in three directions, i.e., the X, Y, and Z axes, so as to effectively avoid the problem that the tool placement bars may get loose and displaced. This is truly an inventive step. Another technical feature is that the pressing edge of the first end three-axis limiting portion is formed with an inclined guiding face. The configuration of the inclined guiding face can enhance the smoothness when inserting the tool placement bar as the first end of the tool placement bar is inserted at an inclined angle. Moreover, the shifting between the positioned state and released state of the tool placement bar is realized by pushing the slide cover to the released position or locked position. The user can operate the shifting easily and conveniently. This is also a practical advantage.

DETAILED DESCRIPTION OF THE INVENTION

Figure 1:
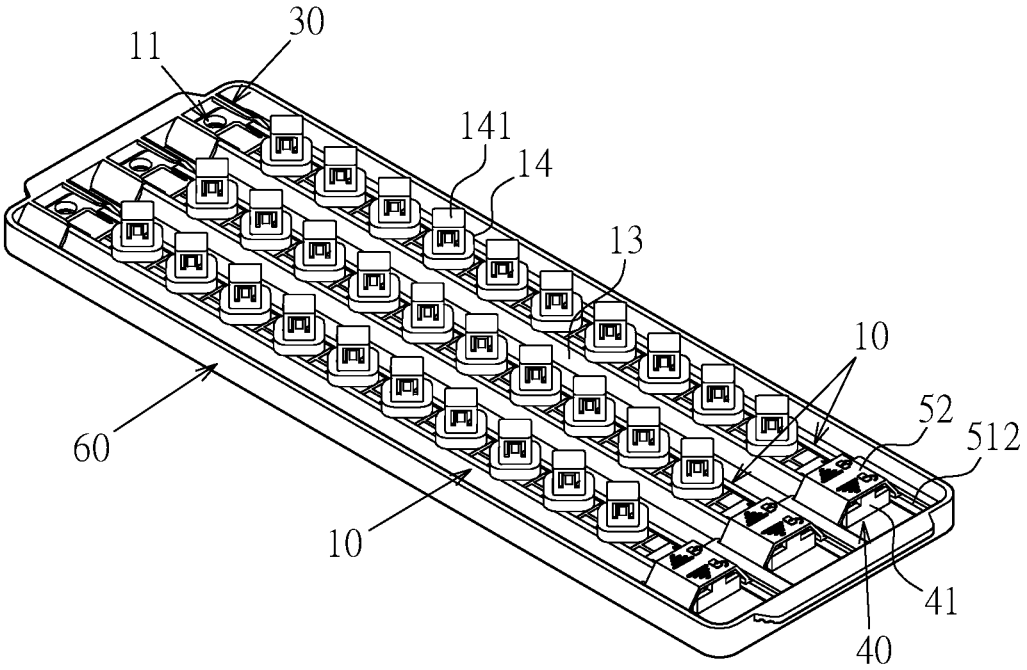
FIG. 1 is a combined perspective view of a preferred embodiment of the invention.

Depicted in FIG. 1 through FIG. 10 is a preferred embodiment of the three-axis end-limiting tool placement structure according to the invention. However, such an embodiment is provided for illustrative purpose only and is not intending to limit the scope of the invention.

The three-axis end-limiting tool placement structure is used for assembly and positioning of at least one tool placement bar 10 in a detachable manner. Each tool placement bar 10 is a long bar-shaped structure, and is formed with a first end 11, a second end 12, and a long plate section 13 located between the first end 11 and the second end 12. The first end 11 and the second end 12 respectively includes an end portion 111(121), a top face 112(122), and side edges 113(123). The long plate section 13 is slidably disposed with a plurality of tool placement seats 14. Each of the tool placement seats 14 is protruded with a tool placement portion 141 (including but not limited to a square socket column), and a Z axis is defined based on the direction toward which the tool placement portion 141 protrudes (see indication in FIG. 3).

Figure 5:
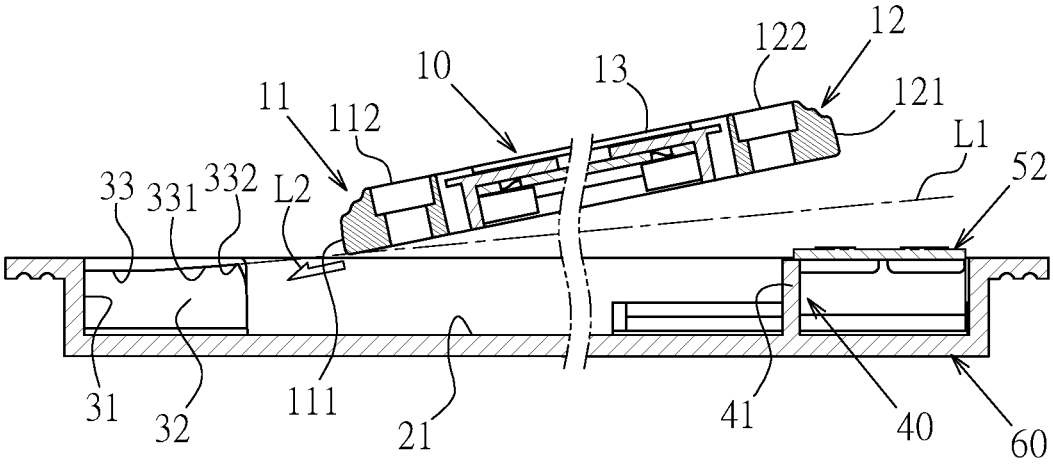
FIG. 5 is a sectional view corresponding to FIG. 4.

The three-axis end-limiting tool placement structure includes the following constituents: a basic face portion 20, with an X axis and a Y axis (see indication in FIG. 3) defined based on the direction toward which the basic face portions 20 extend away from each other, and at least one placement zone 21 is defined by the basic face portion 20; a first end three-axis limiting portion 30, formed in each of the placement zones 21 of the basic face portion 20 and at a position corresponding to the first end 11 of each of the tool placement bar 10. The first end three-axis limiting portion 30 includes an end-side abutting wall 31, two lateral limiting walls 32 and at least one pressing edge 33, wherein the end-side abutting wall 31 is used to abut the corresponding end portion 111 of the first end 11 of the tool placement bar 10, so that the X axis is rigidly abutted and limited. The two lateral limiting walls 32 are used to abut the corresponding side edges 113 of the first end 11 of the tool placement bar 10, so that the Y axis is rigidly abutted and limited. The at least one pressing edge 33 is used to press the corresponding top face 112 of the first end 11 of the tool placement bar 10, so that the Z axis is rigidly abutted and limited. Moreover, each pressing edge 33 is further formed with an inclined guiding face 331. The inclined guiding face 331 has an inclined upper inlet end 332. A second end X axis limiting portion 40, formed in each of the placement zones 21 of the basic face portion 20 and at a position corresponding to the second end 12 of the tool placement bar 10. The shape of the second end X axis limiting portion 40 is to limit at least the X axis of the corresponding second end 12 of the tool placement bar 10. A second end sliding Z axis stopper 50, formed at a position adjacent to the second end X axis limiting portion 40. The second end sliding Z axis stopper 50 includes a rail set 51 and a slide cover 52, wherein the slide cover 52 is slidably disposed on the rail set 51 and can be pushed to move back and forth along the X axis, so that the slide cover 52 can have a released position and a locked position in usage. Specifically, when the slide cover 52 is at the locked position, it is used to cover and stop the top face 122 of the second end 12 of the tool placement bar 10, so as to limit the Z axis, and when the slide cover 52 is at the released position, the second end 12 of the tool placement bar 10 is released to be movable in the direction of the Z axis. Moreover, as shown in FIG. 5, an inclined upward extending line L1 is defined based on the inclined upper inlet end 332 of the inclined guiding face 331, and the extending path of the inclined upward extending line L1 is configured above the top end of the slide cover 52 of the second end sliding Z axis stopper 50. Such a configuration is provided for the tool placement bar 10 to be inserted smoothly, and to prevent its second end 12 from being blocked by the slide cover 52.

Figure 2:
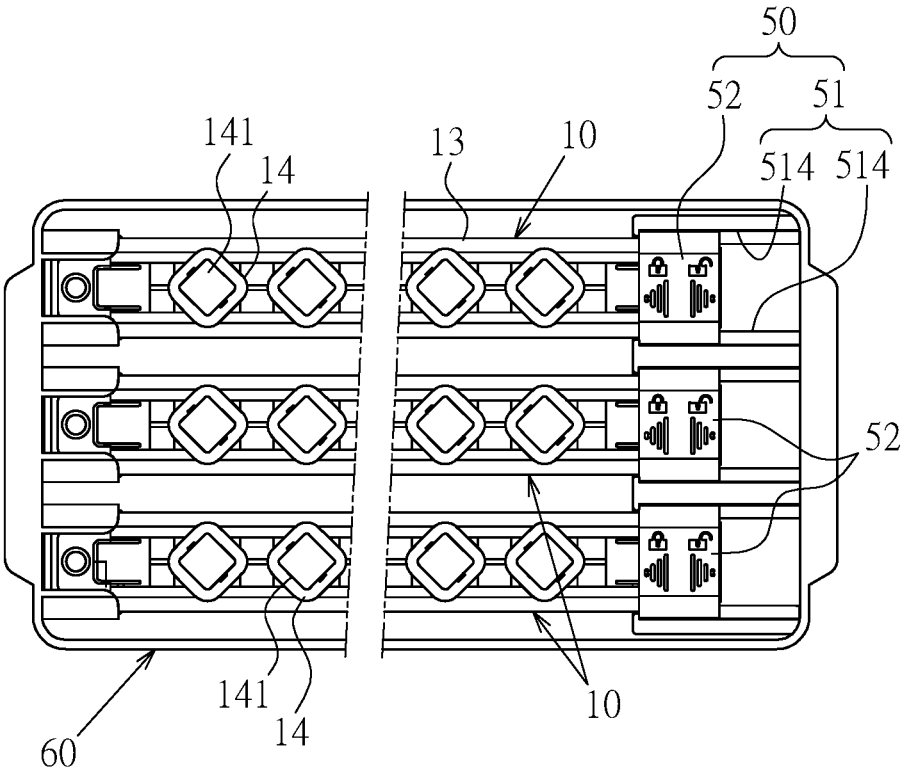
FIG. 2 is a top view of a preferred embodiment of the invention.
Figure 14:
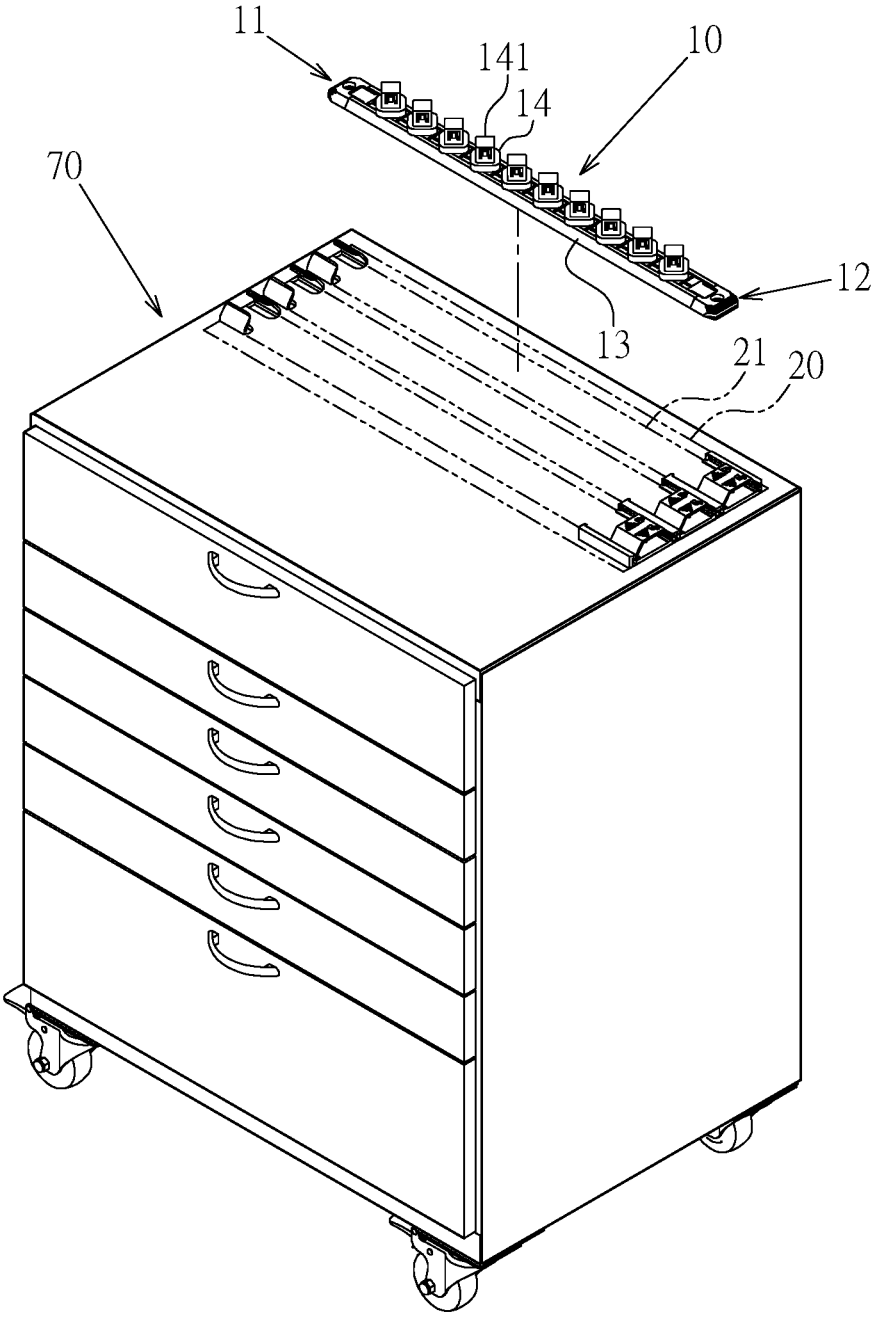
FIG. 14 is an implementation view of the invention with the basic face portion formed on the structure of the tool storage appliance.

Specifically, the implementation of the basic face portion 20 can be any of the following forms: first, formed on the structure of a tray 60 (as shown in FIGS. 1, 2); second, as shown in FIG. 14, formed on a local surface of the structure of a tool storage appliance 70. The tool storage appliance 70 can be any of a tool box, a tool shelf or a tool cabinet.

Figure 3:
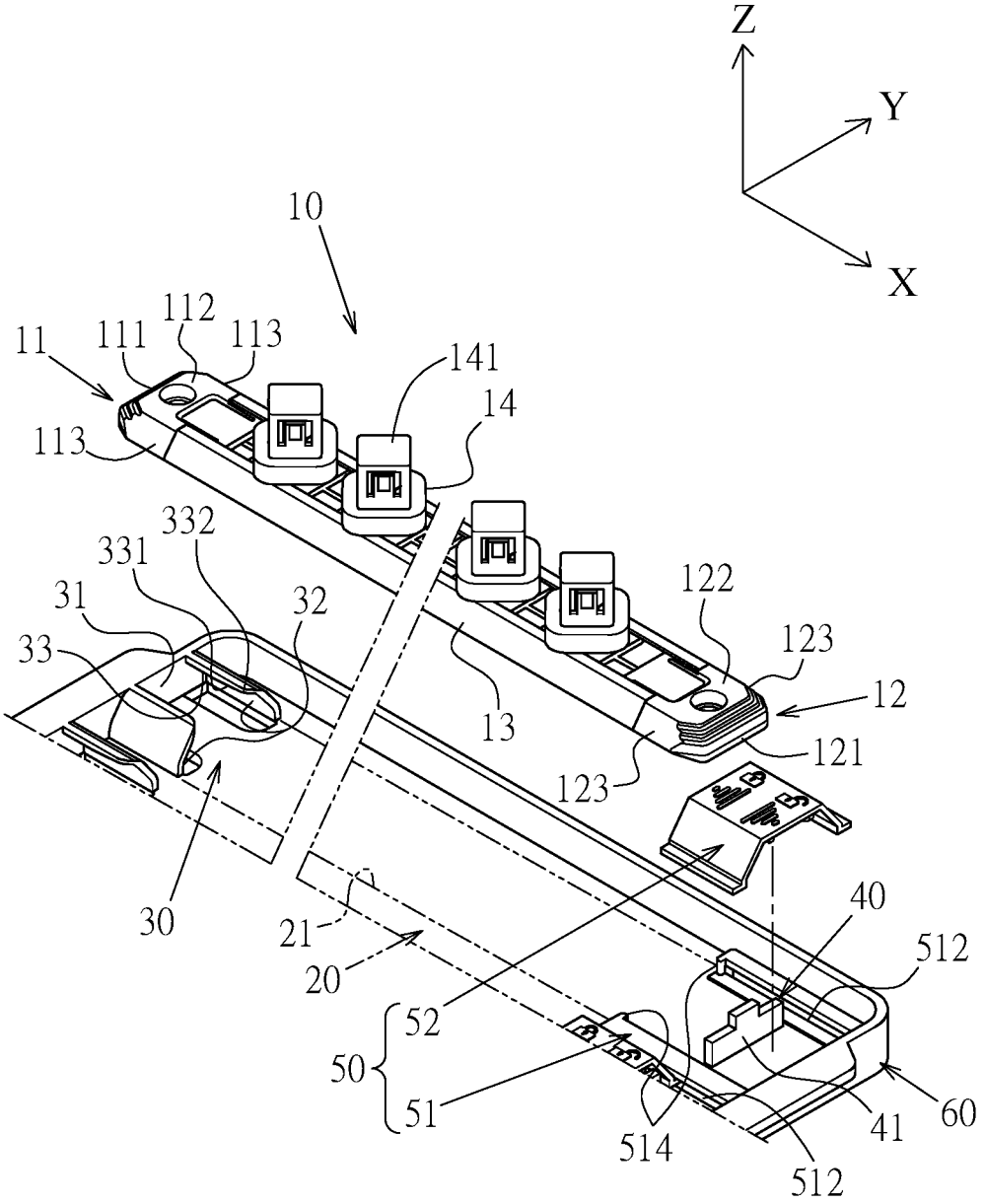
FIG. 3 is an exploded perspective view of partial structure of a preferred embodiment of the invention.

As shown in FIG. 3, in this embodiment, the second end X axis limiting portion 40 includes a convex stopping plate 41 formed on the basic face portion 20. The convex stopping plate 41 is perfectly shaped and positioned to abut the corresponding end portion 121 of the second end 12 of the tool placement bar 10 in the direction of the X axis (see FIG. 9).

Figure 12:
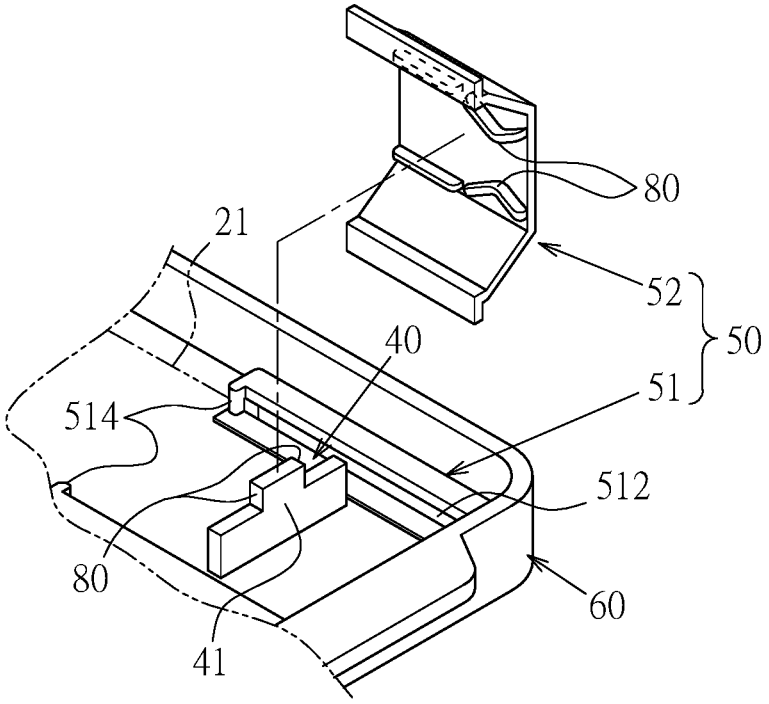
FIG. 12 is an implementation view of the invention with the convex stopping plate and slide cover relatively configured with inserting and limiting structures matching each other.
Figure 13:
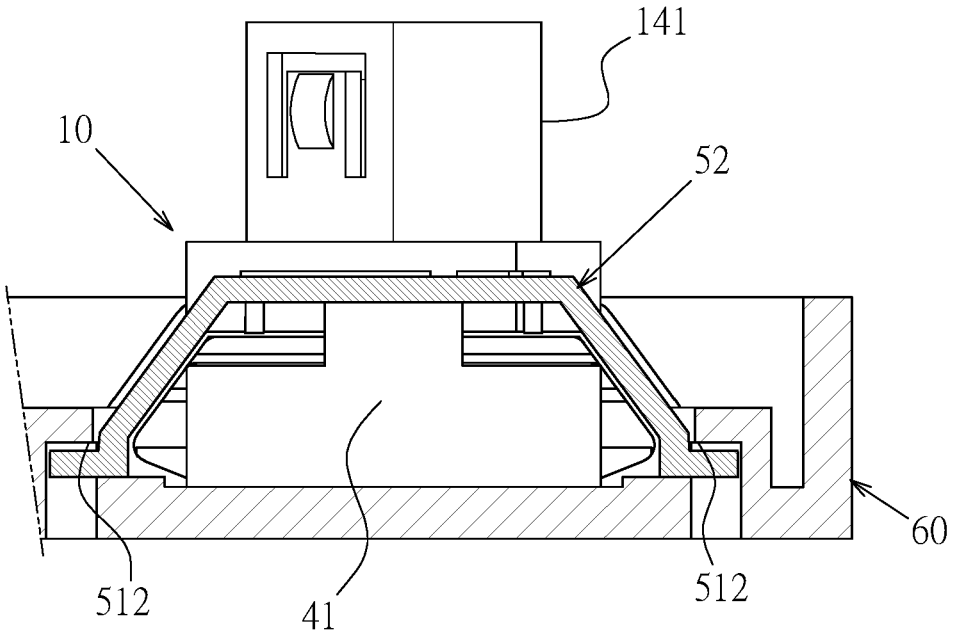
FIG. 13 is a sectional view of the slide cover and rail set of the invention in the assembled state.

In the embodiment disclosed in the previous paragraph, the rail set 51 includes a pair of rails 512 configured at an interval. The two rails 512 are relatively formed with two abutting edge portions 514. Between the convex stopping plate 41 and the slide cover 52, a matching inserting and limiting structure 80 is configured (as shown in FIG. 12, the specific inserting shape is not limited), so as to limit the locked position of the slide cover 52. The two abutting edge portions 514 are mainly used as the stopping part when the slide cover 52 moves to the terminal end of the locked position, and can also be used to abut the side edges 123 of the second end 12 of the tool placement bar 10, so as to realize a limitation in the direction of the Y axis.

Figure 4:
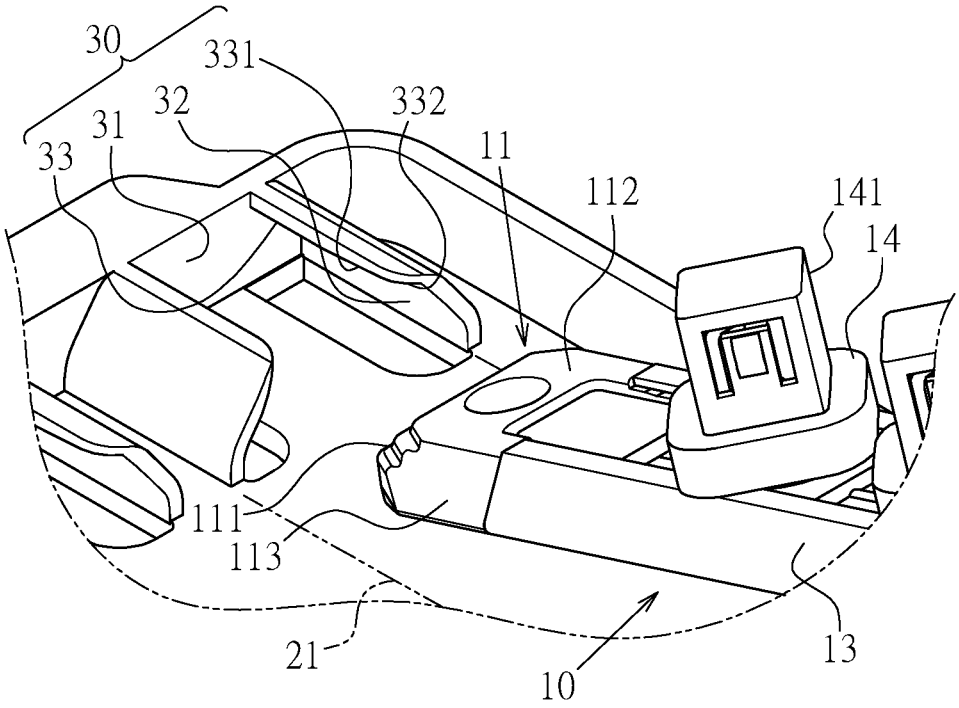
FIG. 4 is a perspective view of the tool placement bars of the invention in Step 1 of the assembly process.
Figure 6:
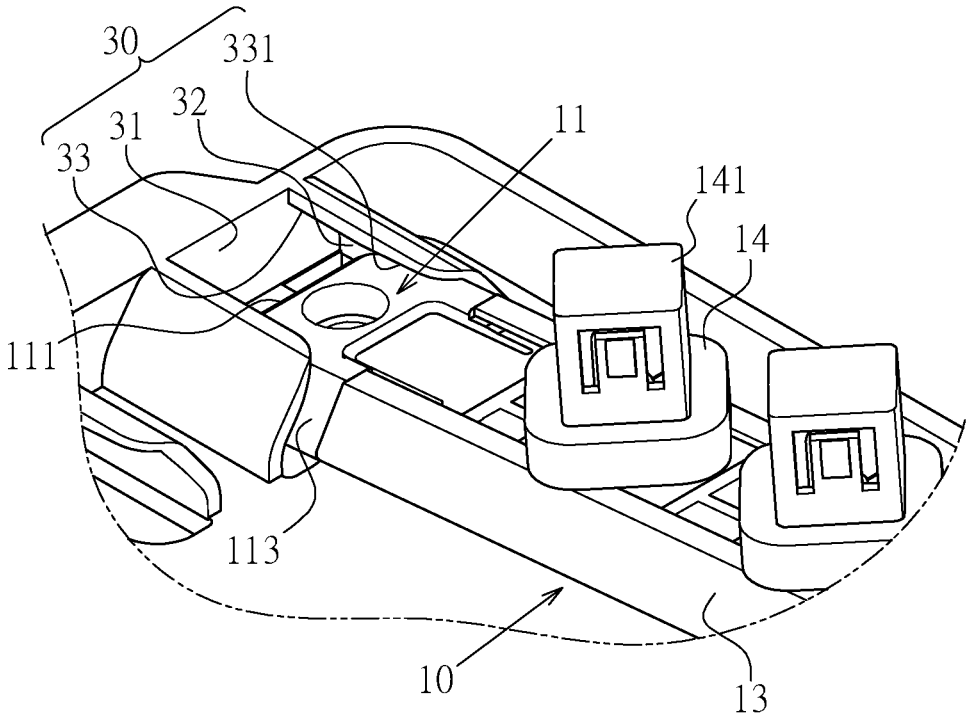
FIG. 6 is a perspective view of the tool placement bars of the invention in Step 2 of the assembly process.
Figure 7:
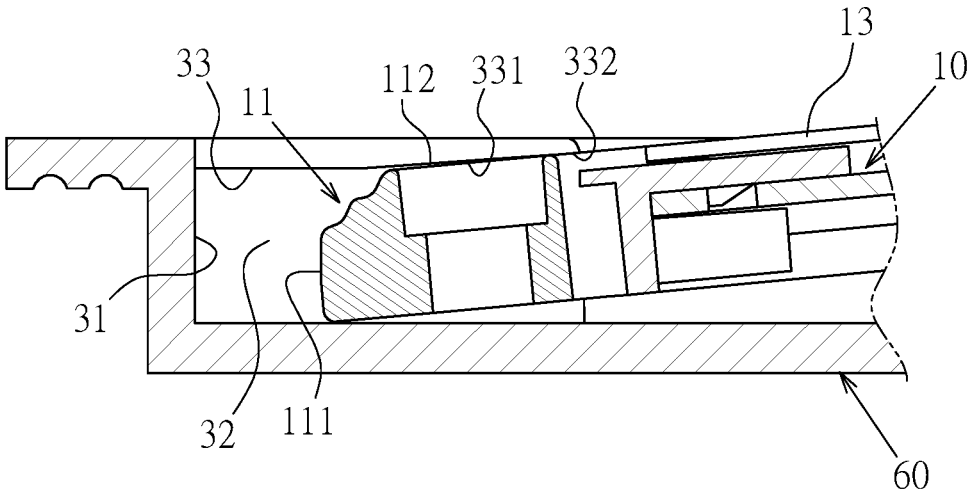
FIG. 7 is a sectional view corresponding to FIG. 6.
Figure 8:
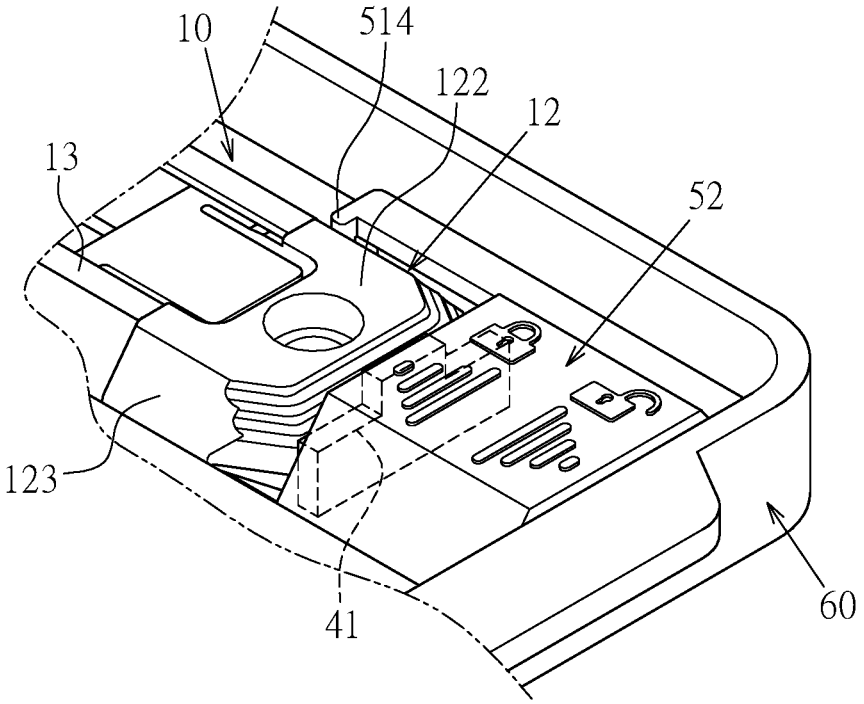
FIG. 8 is a perspective view of the tool placement bars of the invention in Step 3 of the assembly process.
Figure 9:
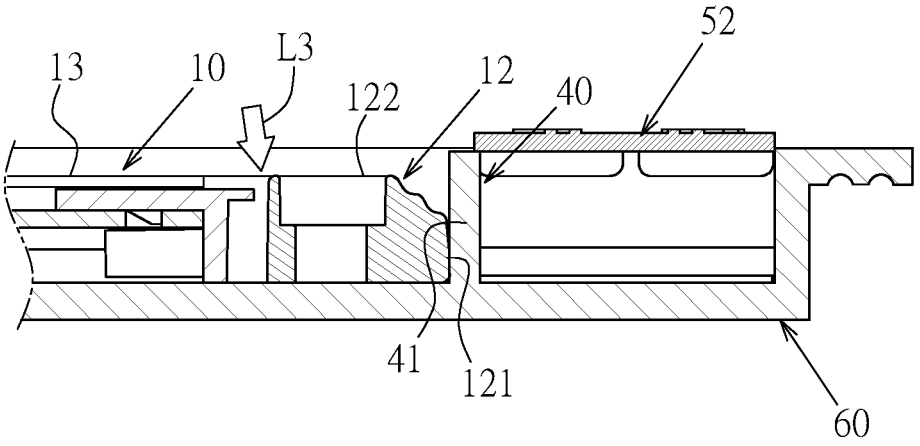
FIG. 9 is a sectional view corresponding to FIG. 8.
Figure 10:
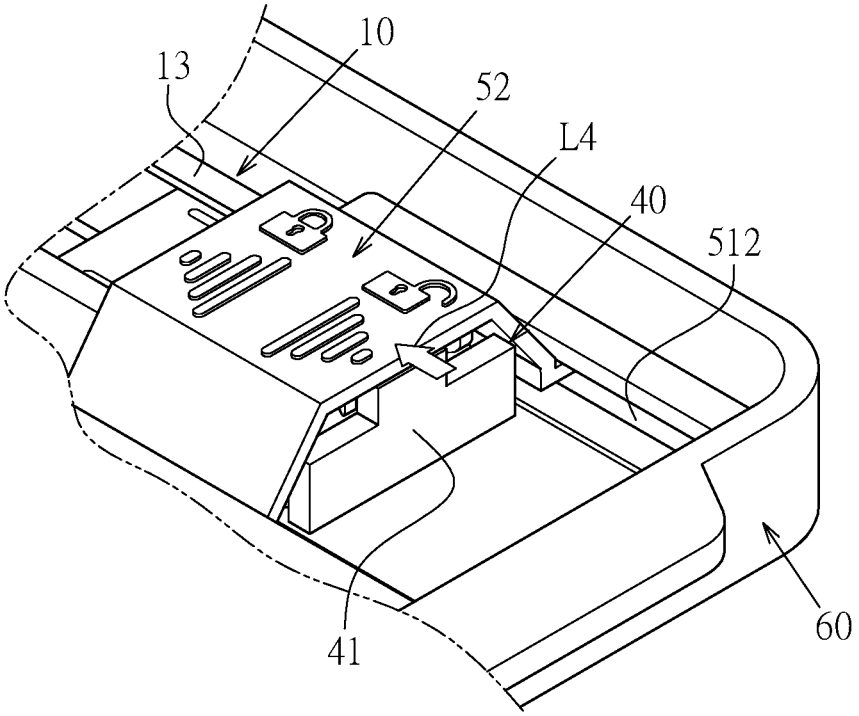
FIG. 10 is a perspective view of the tool placement bars of the invention in Step 4 of the assembly process.
Figure 11:
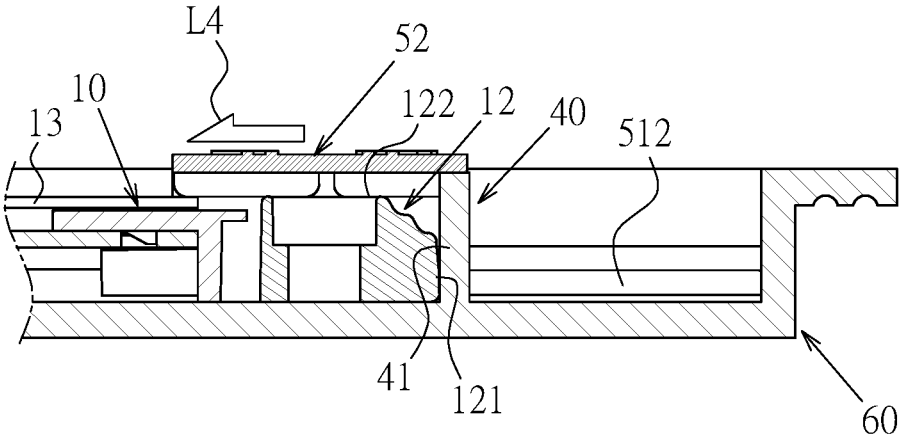
FIG. 11 is a sectional view corresponding to FIG. 10.

Based on the above structural design and technical features, the present invention of a three-axis end-limiting tool placement structure has made an improvement over the prior art. In the use of the above-mentioned embodiment, firstly, as shown in FIG. 4 and FIG. 5, when the user needs to assemble the tool placement bar 10 in the placement zone 21, the first end 11 of the tool placement bar 10 is moved in a downward inclined angle toward the first end three-axis limiting portion 30 (as indicated by Arrow L2 in FIG. 5). Then, as shown in FIG. 6 and FIG. 7, the end portion 111 of the first end 11 of the tool placement bar 10 is moved continuously till it is inserted and abutted by the end-side abutting wall 31. Then, as shown in FIG. 8 and FIG. 9, the second end 12 of the tool placement bar 10 is pressed down (as indicated by Arrow L3 in FIG. 9), so that it is positioned on the second end X axis limiting portion 40 and the end portion 121 of the second end 12 is abutted on the convex stopping plate 41. Then, as shown in FIG. 10 and FIG. 11, the slide cover 52 is slid from the released position (as indicated by Arrow L4 in FIG. 10 and FIG. 11) to the locked position, so that it covers and blocks the top face 122 of the second end 12 of the tool placement bar 10, and a limitation in the direction of the Z axis is realized. In this way, the assembled and positioned state of the tool placement bar 10 depicted in FIG. 1 and FIG. 2 is realized. Specifically, the first end 11 and the second end 12 of the tool placement bar 10 can both be stably positioned in all directions of the X, Y and Z axes. As we can see, the assembled state of the tool placement bar 10 disclosed in the present invention is very stable, without any possibility to move toward the direction of any axis and get loose. Thus, it is more safe to use. And the invention has solved the problem that the tool placement bar 10 may fall apart from the placement zone 21. The shifting between the positioned state and the released state of the tool placement bar 10 is realized by pushing the slide cover 52 to the released position or the locked position. It is very convenient for the user to operate.

I claim:

1. A three-axis end-limiting tool placement structure, used for assembly and positioning of at least one tool placement bar in a detachable form, each tool placement bar is a long bar-shaped structure and is formed with a first end, a second end, and a long plate section located between the first end and the second end, the first end and the second end respectively include an end portion, a top face and side edges, the long plate section is slidably disposed with a plurality of tool placement seats, each of the tool placement seats is protruded with a tool placement portion, and a Z axis is defined based on the direction toward which the tool placement portion protrudes, the three-axis end-limiting tool placement structure includes:

a basic face portion, with an X axis and a Y axis defined based on the directions toward which the basic face portions extend away from each other, and at least one placement zone is defined by the basic face portion;

a first end three-axis limiting portion, formed in each of the placement zones of the basic face portion at a position corresponding to the first end of the tool placement bar, the first end three-axis limiting portion includes an end-side abutting wall, two lateral limiting walls, and at least one pressing edge, wherein the end-side abutting wall is used to abut the corresponding end portion of the first end of the tool placement bar, so that the X axis is rigidly abutted and limited, the two lateral limiting walls are used to abut the corresponding side edges of the first end of the tool placement bar, so that the Y axis is rigidly abutted and limited, the at least one pressing edge is used to press the corresponding top face of the first end of the tool placement bar, so that the Z axis is rigidly abutted and limited; each pressing edge is further formed with an inclined guiding face, the inclined guiding face has an inclined upper inlet end;

a second end X axis limiting portion, formed in each of the placement zones of the basic face portion and at a position corresponding to the second end of the tool placement bar, the shape of the second end X axis limiting portion is to limit at least the X axis of the corresponding second end of the tool placement bar; and a second end sliding Z axis stopper, formed at a position adjacent to the second end X axis limiting portion, the second end sliding Z axis stopper includes a rail set and a slide cover, wherein the slide cover is slidably disposed on the rail set and can be pushed to move back and forth along the X axis, so that the slide cover can have a released position and a locked position in usage;

specifically, when the slide cover is at the locked position, it is used to cover and stop the top face of the second end of the tool placement bar, so as to limit the Z axis, and when the slide cover is at the released position, the second end of the tool placement bar is released to be movable in the direction of the Z axis;

further, an inclined upward extending line is defined based on the inclined upper inlet end of the inclined guiding face, and the extending path of the inclined upward extending line L1 is configured above the top end of the slide cover of the second end sliding Z axis stopper.

2. The three-axis end-limiting tool placement structure defined in claim 1, wherein the basic face portion is implemented in any of the following forms:

first, formed on the structure of a tray;

second, formed on a local surface of the structure of a tool storage appliance, the tool storage appliance is any of a tool box, a tool shelf or a tool cabinet.

3. The three-axis end-limiting tool placement structure defined in claim 1, wherein the second end X axis limiting portion includes a convex stopping plate formed on the basic face portion, the convex stopping plate is perfectly shaped and positioned to abut the corresponding end portion of the second end of the tool placement bar in the direction of the X axis.

4. The three-axis end-limiting tool placement structure defined in claim 2, wherein the second end X axis limiting portion includes a convex stopping plate formed on the basic face portion, the convex stopping plate is perfectly shaped and positioned to abut the corresponding end portion of the second end of the tool placement bar in the direction of the X axis.

5. The three-axis end-limiting tool placement structure defined in claim 3, wherein the rail set includes a pair of rails distributed at an interval, and the two rails are relatively formed with two abutting edge portions.

6. The three-axis end-limiting tool placement structure defined in claim 4, wherein the rail set includes a pair of rails distributed at an interval, and the two rails are relatively formed with two abutting edge portions.

7. The three-axis end-limiting tool placement structure defined in claim 3, wherein, between the convex stopping plate and the slide cover, a matching inserting and limiting structure is configured, so as to limit the locked position of the slide cover.

8. The three-axis end-limiting tool placement structure defined in claim 4, wherein, between the convex stopping plate and the slide cover, a matching inserting and limiting structure is configured, so as to limit the locked position of the slide cover.

* * * * *